US005797830A

United States Patent [19]

Flores et al.

[11] Patent Number: 5,797,830

[45] Date of Patent: Aug. 25, 1998

[54] MULTI USE PAPER AND CARD STOCK CUTTER

[75] Inventors: Albert Flores, 1551 Monte Sander, El Paso, Tex. 79936; Ricardo Molina, El Paso, Tex.

[73] Assignee: Albert Flores, El Paso, Tex.

[21] Appl. No.: 614,366

[22] Filed: Mar. 12, 1996

[51] Int. Cl.[6] ..... B31B 1/14

[52] U.S. Cl. ..... 493/361; 493/355; 493/363; 493/366; 271/127; 271/162; 83/501; 83/498

[58] Field of Search ..... 83/471.1, 501, 83/498, 106, 105, 495–508.3; 271/9.11, 127, 162, 241; 493/340, 353, 354, 355, 361, 363, 364, 365, 366, 367, 369, 370, 371, 396, 471, 478

[56] References Cited

U.S. PATENT DOCUMENTS

| | | | |
|---|---|---|---|
| Re. 31,521 | 2/1984 | Tokumo | 83/106 |
| 3,122,363 | 2/1964 | Thomas | 271/9.11 |
| 3,208,745 | 9/1965 | March | 271/9.11 |
| 3,290,041 | 12/1966 | Cunningham | 271/9.11 |
| 3,831,502 | 8/1974 | Tokuno . | |
| 3,882,765 | 5/1975 | Tokuno . | |
| 4,033,217 | 7/1977 | Flaum | 83/499 |
| 4,142,455 | 3/1979 | Coburn . | |
| 4,214,495 | 7/1980 | Coburn | 83/425.4 |
| 4,215,609 | 8/1980 | Coburn | 83/492 |
| 4,224,850 | 9/1980 | Holmi | 83/105 |
| 4,476,758 | 10/1984 | Coburn | 83/479 |
| 4,515,052 | 5/1985 | Flaum | 83/479 |
| 4,559,855 | 12/1985 | Schieck | 83/425.3 |
| 4,781,668 | 11/1988 | Mowry | 493/365 |
| 5,026,042 | 6/1991 | Miller | 271/127 |
| 5,120,297 | 6/1992 | Adami | 493/355 |
| 5,228,673 | 7/1993 | Osonoe | 271/127 |
| 5,232,214 | 8/1993 | Matsuura | 271/127 |
| 5,310,171 | 5/1994 | Honma | 271/9.11 |

*Primary Examiner*—Joseph J. Hail, III
*Assistant Examiner*—Christopher W. Day
*Attorney, Agent, or Firm*—Curtis L. Harrington

[57] ABSTRACT

A multi-use cutter is especially useful for cutting standard size paper and card stock into business card sizes. The preferred model of the multi-use cutter will measure six inches deep by fifteen inches tall by fifteen and a half inches wide and will be powered by standard 115 volt alternating current power source. The paper stock is sequentially fed into the cutter and can be collected in catch trays. The starting feed stock size can be varied by simply changing the size of the paper guide. Where the cutters are set to produce an American standard sized two by three and a half inch business card, the starting feedstock can be of any size.

17 Claims, 4 Drawing Sheets

MULTI USE PAPER AND CARD STOCK CUTTER

FIELD OF THE INVENTION

The present invention relates to the field of equipment and structures for cutting multiple sheets of paper and card stock into useful sizes, and for scoring sheets to be folded. More specifically the invention relates to a machine having multiple cutting sections each having a different process setup which is especially useful for sequential processing of paper and card stock.

BACKGROUND OF THE INVENTION

It is well known in the printing industry to start out with a large sheet upon which printing is to be done and to then cut the larger sheet into smaller sizes. In general, this may be done in either of two ways. At the lowest production end, a manual paper cutter can be used on a single sheet of material. This may be of the lever arm type or of the rotating wheel and ruler edge type. However, the resulting cut shapes can vary depending upon the degree of care used by the operator, and even the best operators are physically incapable of producing a uniform product.

At the other end of the scale, large cutting machines are available to simultaneously cut, usually by shearing, large stacks of paper and card stock. These machines are powerful, hydraulic devices which have safety mechanisms to guard against operator accidents. Usually, the operator will center the stack to be cut and then trigger the machine to compress the stack and to cut the stack with a shear blade while the stack is under compression. These machines are extremely expensive and require extensive floor space to be safely located and used.

The small sized printers shop cannot afford the larger machine either in terms of money or in terms of space. Thus, the small print shop employee is faced with the prospect of either using a hand operated cutter or taking the printed materials to a larger facility and paying to have the materials cut.

With improved printing technology, the small printer has an ever increasing chance to produce high quality printed material which was previously only producible with larger printing presses. The two extremes available for cutting, limit the ability of the small printer to capitalize on the improvements in quality of printing. Given the number of cutting operations which must be performed on a standard sized sheet in order to produce cards, the small printer's only other option would be to purchase several specialized and expensive cutters. This would not help either in terms of profitability or space occupied. Another option would be the use of an adjustable cutter which would require re-setting before and after each cutting operation. This also consumes valuable time of the small printer and thus reduces efficiency and profitability.

What is therefore needed is a machine which will occupy a relatively small space, have a relatively modest cost, and yet produce consistent and high quality cuts in paper and card stock. The machine should be able to operate with as little operator intervention as possible and as automatically as possible.

SUMMARY OF THE INVENTION

The multi-use cutter is especially useful for cutting standard size paper and card stock into business card sizes. The preferred model of the multi-use cutter will measure six inches deep by fifteen inches tall by fifteen and a half inches wide and will be powered by standard 115 volt alternating current power source.

The starting feed stock size can be varied by simply changing the size of the paper guide. Where the cutters are set to produce an American standard sized two by three and a half inch business card, the starting feedstock can be of any size.

BRIEF DESCRIPTION OF THE DRAWING

The invention, its configuration, construction, and operation will be best further described in the following detailed description, taken in conjunction with the accompanying drawings in which.

DETAILED DESCRIPTION OF THE PREFERRED EMBODIMENT

Figure 1:
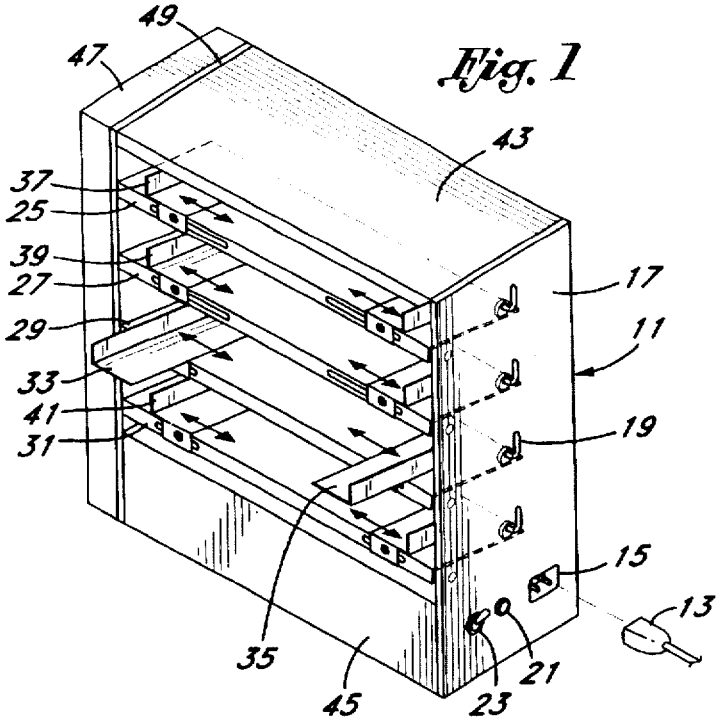
FIG. 1 is a perspective view of the multi-use cutter of the present invention from the right front, or feed side.

The description and operation of the invention will be best described with reference to FIG. 1. FIG. 1 is a perspective view of the multi-use cutter 11 from the front or feed side. Cutter 11 has an electric cord 13 which is connectable with a receptacle 15 within a support plate 17 which serves as the side panel for the cutter 11. A series of four tray hold down feed levers 19 are shown oriented in the upward direction. Also shown adjacent to the receptacle 15 is a fuse holder 21 and an on/off switch 23.

Also seen in FIG. 1 are a series of four paper trays, numbered from the top 25, 27, 29, and 31. Paper tray 29 is shown as having a pair of opposing paper guides 33 and 35. The paper guides 33 and 35 are slidably adjustable with respect to the paper tray 29 and thus enable adjustment of the width of the space formed between the paper guides 33 and 35. The other paper trays 25, 27, and 31 have paper guides of an abbreviated length and include paper guides 37 for paper tray 25, paper guides 39 for paper tray 27 and paper guides 41 for paper tray 31. The extended length of the paper guides 33 and 35 reflect the expectation that paper tray 29 will be utilized with longer lengths of paper than the other paper trays 25, 27, and 31.

At the top of the cutter 11 is seen the top portion of a one piece top and rear cover 43. At the lower edge of the cutter 11 of FIG. 1 is a front cover 45. To the left side of the cutter 11 is a mechanism cover 47 which abuts a second support plate 49. The support plates 49 and 17 are structurally stable and provide the main supports from which the other components of the cutter 11 depend for support.

Figure 2:
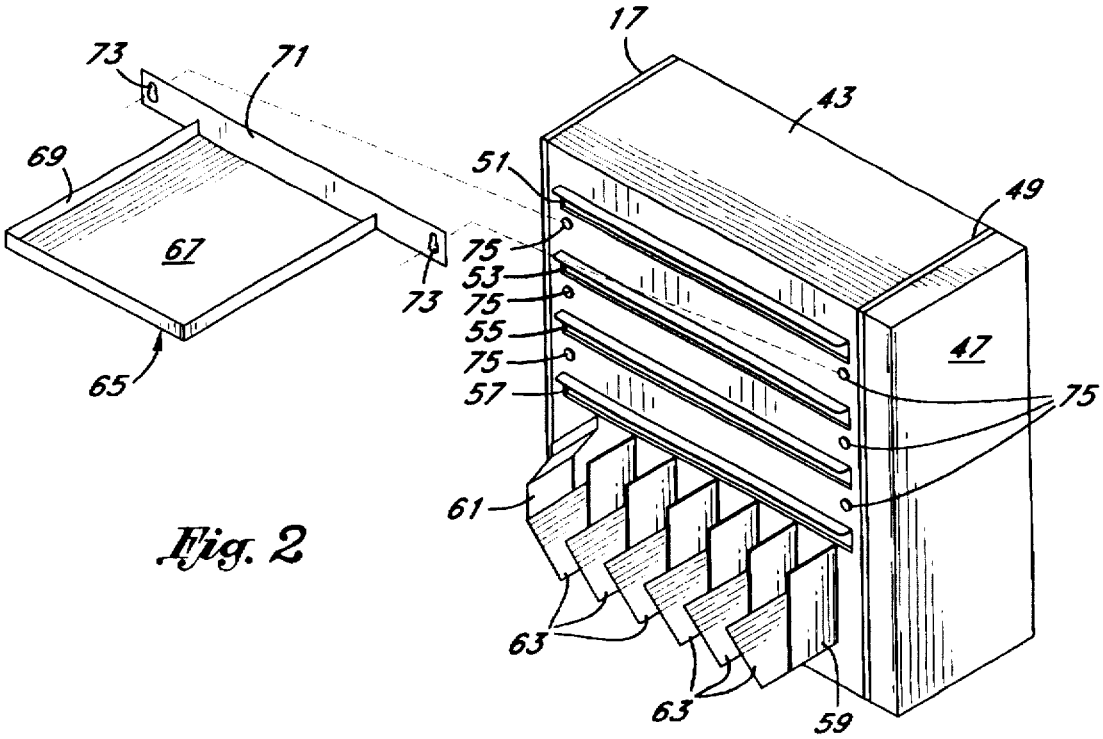
FIG. 2 is a perspective view of the cutter of FIG. 1 from the rear side and illustrating a catch tray in exploded relationship to the cutter.

Referring to FIG. 2, a rear perspective view of the cutter 11 is seen and illustrates the rear portion of the top and rear cover 43. The cover 43 supports several structures including a set of four slots 51, 53, 55, and 57 which correspond to the trays 25, 27, 29, and 31, respectively. Each slot 51, 53, 55, and 57 is formed by punching and leaves a slight overhanging lip over the entrance to each slot 51, 53, 55, and 57. A series of dividers known as card diffusers 59 extend outwardly from the top and rear cover 43. At the leftmost portion of the top and rear cover 43 a covering divider 61 lies to the left of the leftmost diffuser 59 to complete a space into which cards 63 will fall in an orderly fashion after leaving the slot 57.

Also shown in FIG. 2 is a catch tray 65 having a planar portion 67 surrounded by an upwardly directed lip 69. At the front of the tray 65 and attached to the planar portion 67 and lip 69 is a front bracket 71 having a pair of keyhole apertures 73. On the exposed side of the top and rear cover 43 is a series of rivet heads or screw heads 75 which are spaced to interfit with the keyhole apertures 73 and to enable the tray 65 to be locked into position just beneath the slots 51, 53, and 55. With this arrangement, one or more trays 65 can be used to catch the processed paper or card stock which flows out of the slots 51, 53, and 55. With three trays 65, all of the slots 51, 53 and 55 will have adequate support for paper which as just been cut.

Figure 3:
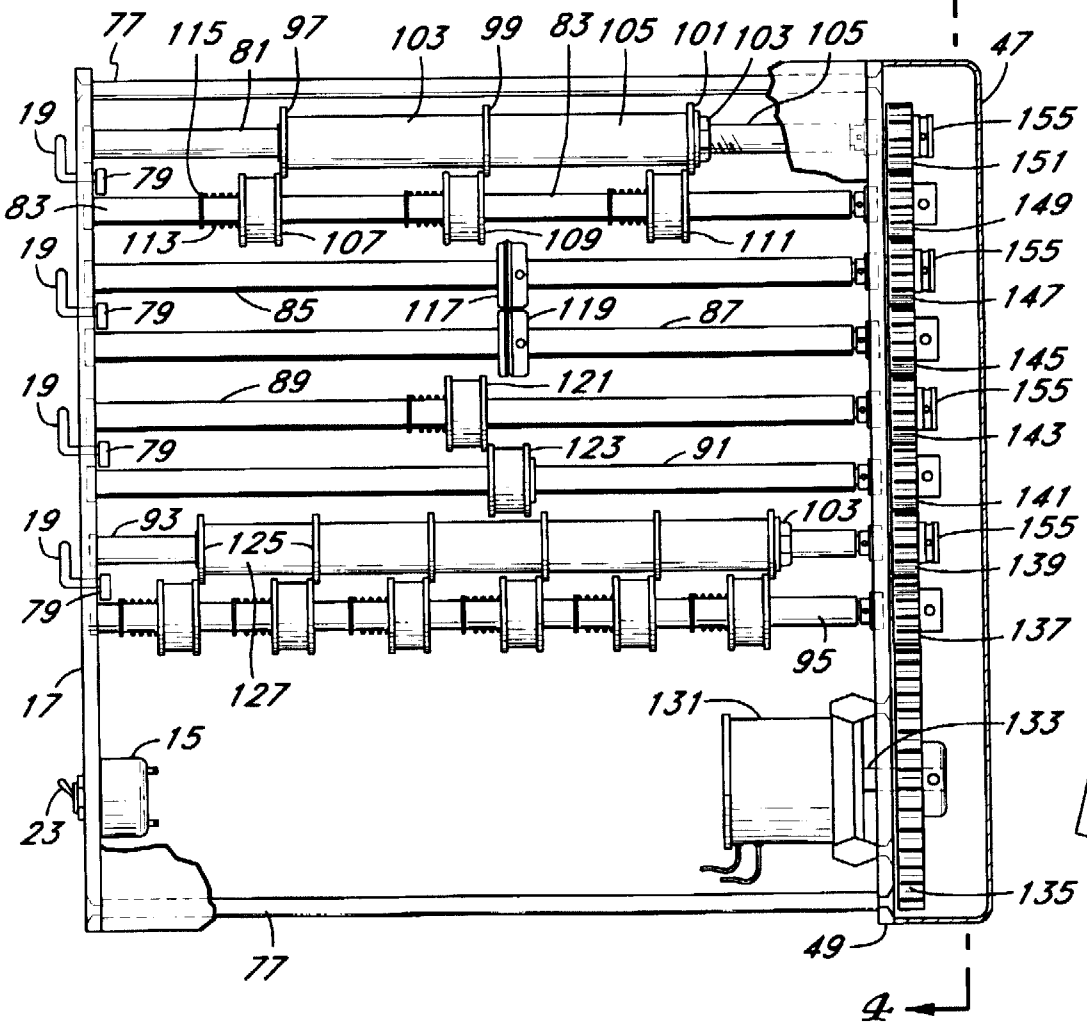
FIG. 3 is a rear view of the cutter of FIGS. 1 and 2 with the top back cover removed and illustrating the blade shafts and mounted blades and gearing arrangement.

FIG. 3 is a plan view looking into the rear of the cutter 11 with the top and rear cover 43 removed. As can be seen, the support plates 17 and 49 are supported together by a series of support plate spacers 77 located at the bottom and top of the support plates 17 and 49 and at other locations as may be necessary. The spacers 77 may typically be made of metal rod with threaded taps at the ends to enable bolted support through apertures located in the support plates 17 and 49.

As can be seen, the switch 23 and the inner portion of the receptacle 15 are shown as being supported by the support plate 17. Each of the tray hold down levers 19 are shown as extending through the support plate 17 and terminate in a series of cam disks 79 which rotate inside of and adjacent the support plate 17. As will be shown, the rotation of the cam discs will cause the raising and lowering of feed trays to enable the paper to engage a feed roller.

A series of rotatable members are seen supported by the cutter 11. From the top, a blade shaft 81 cooperates with a blade shaft 83, followed by a scoring shaft 85 which cooperates with a scoring shaft 87, followed by a blade shaft 89 cooperates with a blade shaft 91, followed by a blade shaft 93 cooperates with a blade shaft 95.

Each of the pairs of cooperating shafts will rotate in opposite directions as will be shown by their gearing. In order to achieve good pressure between the blades, each of the blade shaft sets is configured using plastic spacers supporting a series of circular blades on one shaft, combined with blades on the associated shaft which are urged along its shaft into contact with the stationary blade.

On blade shaft 81, thin circular blades 97, 99 and 101, are separated by a pair of plastic spacers 103 and 105. The spacer 103 separates the circular blades 97 and 99, while the spacer 105 separates the circular blades 99 and 101. The spacers are preferably 3⅜ inches long, and of slightly less diameter than the circular blades 97, 99, and 101. The assembly of the blade shaft 81 is secured by engagement of a nut 103 against a threaded portion of the blade shaft 81.

The blade shaft 83 carries a series of three reversible, double edged circular blades 107, 109, and 111. Each double edged circular blade 107, 109 and 111 is urged to the right by an associated compression spring 113 each of which acts against an associated snap ring 115 which engages its own groove on the blade shaft 83 (groove not shown). Each of the double edged circular blades 107, 109 and 111 is urged laterally against its associated thin circular blades 97, 99 and 101.

Scoring shaft 85 carries a male scoring roller 117, while scoring shaft 87 carries a female scoring roller 119. The male scoring roller 117 carries an angled rib which fits within a female slot on the female scoring roller 119. The scoring rollers are used to place a sharp crease in card stock material passed therebetween.

It is understood that instead of scoring rollers 117 and 119, that a perforating wheel set could be used. Perforating wheels are somewhat more like gears in that a male perforating wheel will have a series of shallow projections which are relatively deeper than the projection on the scoring roller 117. A female perforating wheel will have a corresponding series of deeper projections which mate with the male projections on the male perforating wheel. It is further understood that the cutters of the present invention could all be replaced by perforating wheels if it were desired to produce sheets which could be manually separated into smaller card sized sheets, rather than producing the pre-cut smaller card sized sheets.

On blade shaft 89, a central double edged circular blade 121 is similarly urged by a spring 113 against a central double edged circular blade 123 located on blade shaft 91. This central cutter of blades 121 and 123 are used for a variety of tasks, including the cutting of invitations. By adjusting the feed tray guides 39 to one side or the other, any dimension of cut can be achieved. This cutter section is particularly useful in combination with the scoring rollers 117 and 119. Invitations which have been cut are typically scored to produce an even fold.

On blade shaft 93, and in a similar manner as was shown for blade shaft 81, a series of six thin circular blades 125 are separated by a series of plastic spacers 127. The plastic spacers are preferably 1⅞ inches long. On blade shaft 95, a series of six double edged circular blades 129 are urged against the blades 125 of blade shaft 93. Each of the blades 129 have an associated spring 113 and snap ring 115.

The nominal dimensions for the lengths of the spacers 103 and 105, in combination with the thickness of the blades 97, 99, 101 give a three and a half inch spacing between the cutting junctions of the blades 97, 99, and 101. Likewise, the nominal dimensions for the lengths of the spacers 127, in combination with the thickness of the blades 125 yield a two inch spacing between the cutting junctions of the blades 125.

On the right side of FIG. 3, at the bottom, an electric motor 131 is mounted to the support plate 49. The motor 131 has a drive shaft 133 which extends through the support plate 49 and to the outside of the support plate 49 where it is attached to a drive gear 135. Drive gear 135 engages a first driven gear 137 attached to blade shaft 95. First driven gear 137 engages a second driven gear 139 which is attached to blade shaft 93. Second driven gear 139 engages a third driven gear 141 which is attached to blade shaft 91. Third driven gear 141 engages a fourth driven gear 143 which is attached to blade shaft 98. Fourth driven gear 143 engages a fifth driven gear 145 which is attached to blade shaft 87. Fifth driven gear 145 engages a sixth driven gear 147 which is attached to blade shaft 85. Sixth driven gear 147 engages a seventh driven gear 149 which is attached to blade shaft 83. Finally, seventh driven gear 149 engages an eighth driven gear 151 which is attached to blade shaft 81.

Figure 4:
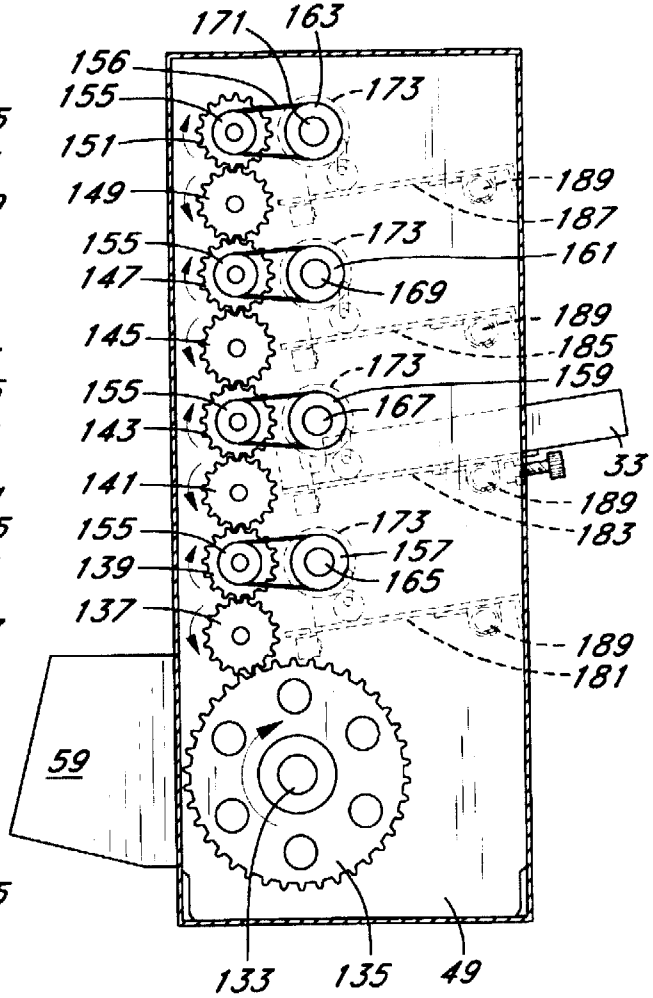
FIG. 4 is a side view of the cutter of FIGS. 1–3 and illustrating a plan view of the gearing scheme of the cutter.

Referring to FIG. 4, a side view looking upon the support plate 49 better illustrates the drive gear 135, and the driven gears 137, 139, 141, 143, 145, 147, 149 and 151. As can be seen by the gearing arrangement of FIG. 4, the driven gear adjacent pairs 137/139, 141/143, 145/147, and 149/151 turn oppositely and in a direction that causes paper stock being cut to be pulled through the blade shafts associated with such adjacent pairs of driven gears.

In addition, the driven gears 139, 143, 147, and 151 are shown as being fitted with drive pulleys 155. As is shown in FIG. 4, each of the drive pulleys 155 is fitted with a drive band 156 which engages a series of driven pulleys. Driven pulleys 157, 159, 161, and 163 are driven by the driven gears 139, 143, 147, and 151, respectively. The driven pulleys 157, 159, 161, and 163 are associated with roller shafts 165, 167, 169, and 171. The roller shafts 165, 167, 169, and 171 are connected to rollers 173 shown in phantom, whose purpose is to feed sheets to the cutter wheels.

As can also be seen from FIG. 4, a thumbscrew 175 is utilized to adjust the paper guide 33. The thumbscrew 175 provides needed assistance for the fixation of the paper guide 33 due to the significant overhang of the paper guide 33. As also shown in phantom, there is a series of paper trays 181, 183, 185, and 187 which are spring loaded to be naturally urged upwardly. The cam disks 79 can be rotated to force the trays 181, 183, 185, and 187 downwardly to facilitate the loading of paper onto the trays.

When the cutter 11 is operating, all of the mechanical components are running. The cam disks 79 is rotated to force the trays 181, 183, 185 and 187 downwardly to enable paper to be loaded but yet not engaged by the rollers 173 located over the trays 181, 183, 185, and 187. When the cam disks 79 are rotated away from urging contact with the trays 181, 183, 185, and 187, the rollers 173 will begin feeding the paper. In this manner, the machine can be operated, one tray at a time using tray hold down levers 19 to selectably operate upon each of the trays 181, 183, 185, and 187. The cam disks 79 are rotated down by angularly displacing the tray hold down levers 19 into a position to cause the cam disks 79 to eccentrically force the associated tray 181, 183, 185, and 187 downwardly against its upwardly springingly urged force.

Note that the trays 181, 183, 185, and 187 are pivotally attached between the support plates 17 and 49 at pivot attachment points 189. When the levers 19 are actuated, each of the trays 181, 183, 185, and 187 pivots about its associated pivot attachment point 189, to lower and make space between the tray and the rubber roller 173. Once paper is loaded in, the release of the levers 19 enables the particular tray 181, 183, 185, and 187 to be urged upwardly to cause any paper stock supported by the tray to engage the rubber rollers 173. Once motor 131 begins actuation, paper will be drawn into the cutting blade areas, one sheet at a time, to begin cutting.

Figure 5:
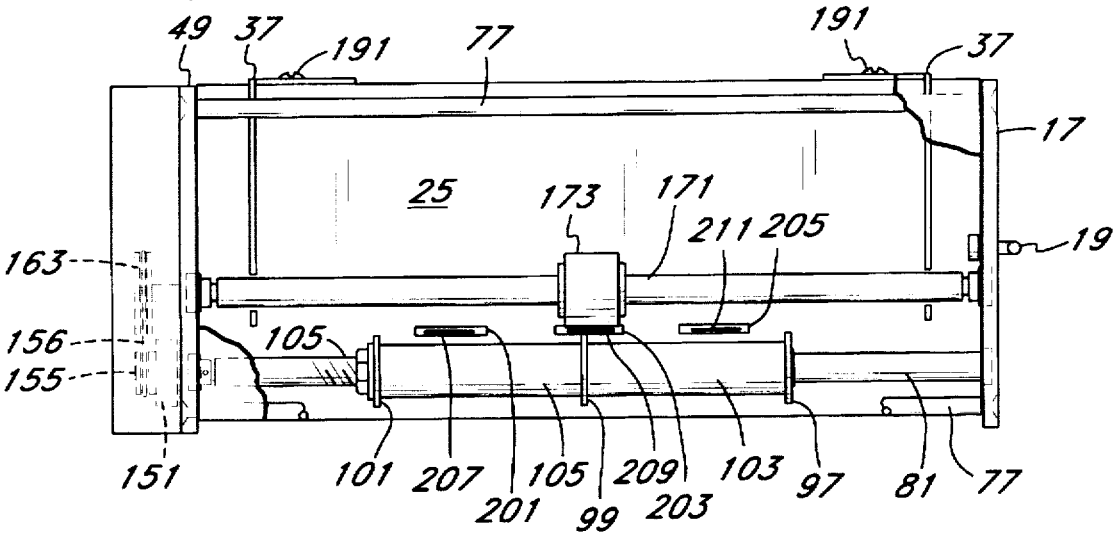
FIG. 5 is a top view of the cutter of FIGS. 1 and 2 with the top back cover removed and illustrating the relationship of the top most cutter shaft with respect to the top most roller shaft and roller.

Referring to FIG. 5, a top view of the cutter 11 as is shown in FIG. 4 shows the spatial arrangement of the structures which are nearest the top of the cutter 11. As can be seen, blade shaft 81, which is driven by the driven gear 151, drives the roller shaft 171 through the combination of the pulley 155, drive band 156, and the driven pulley 163. Roller shaft 171 drives the rubber roller 173 which feeds any paper or card stock present through the cutters 97, 99, and 101.

Also seen in FIG. 5 is a series of three slots 201, 203, and 205; through which project a series of three paper stops 207, 209 and 211. The paper stops 207, 209 and 211 are fixedly mounted and the three slots 201, 203 and 205 enable the paper tray 25 to pivot up and down without movement of the paper stops 207, 209 and 211. In this manner when the tray 25 is full, the paper stops 207, 209 and 211 extend maximally upwardly with respect to the tray 25 to prevent forward movement of the paper stack. As the paper stack dissipates while the tray 25 rises, the top page of the paper stack will always be able to clear its way over the top of the paper stops 207, 209 and 211.

Figure 6:
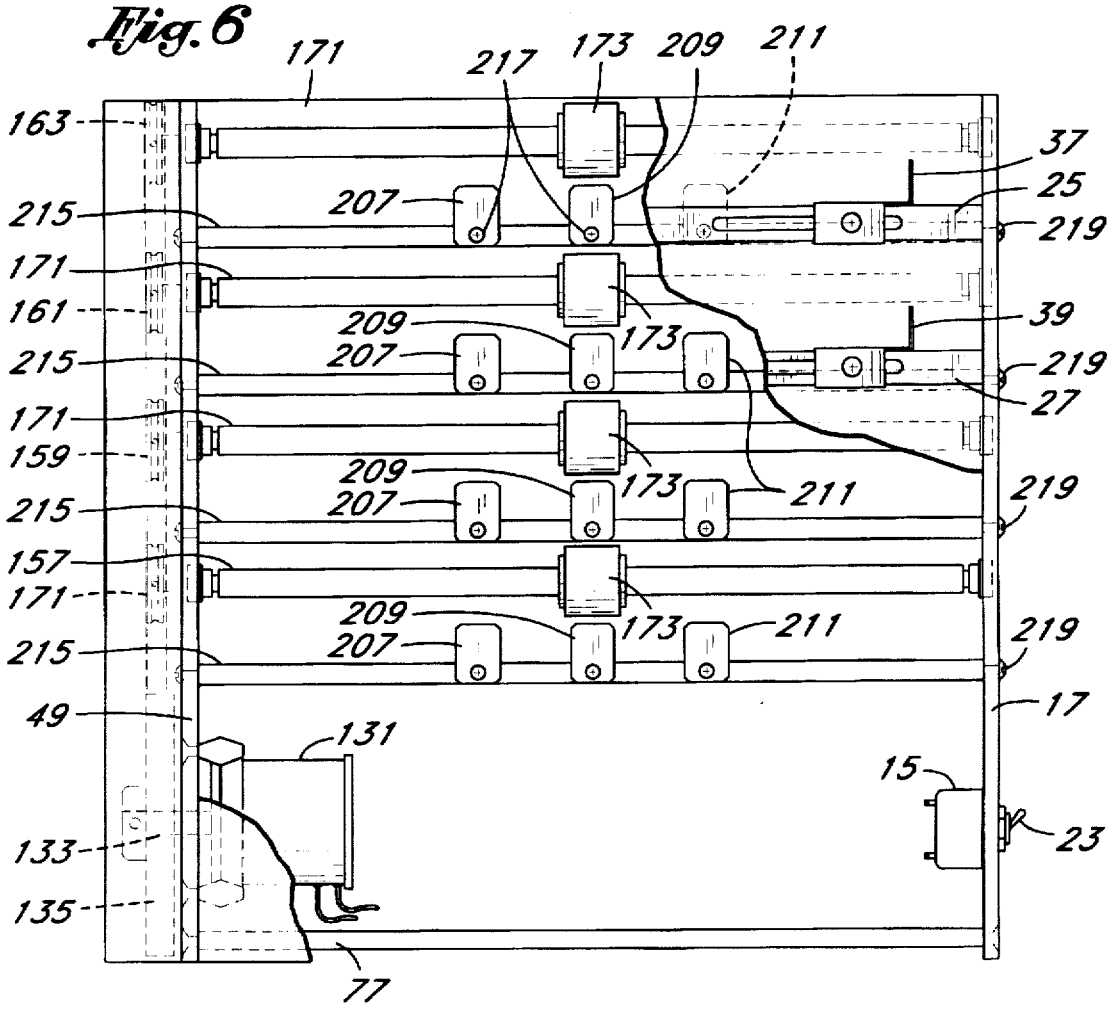
FIG. 6 is a front or feeder side view of the cutter of FIGS. 1 and 2 and emphasizing the trays and paper stops in position to the rollers and roller shafts.

Referring to FIG. 6 a view looking into the feed side of the cutter 11 illustrates that the paper stops 207, 209 and 211 are supported by a paper stop bracket 215 which extends between the support plates 17 and 49 in much the same manner as the support plate spacers 77. There are four paper stop brackets 215, each of which supports a set of three paper stops 207, 209 and 211. Each tray 25, 27, 29, and 31 has the same arrangement with respect to the paper stop brackets 215 and paper stops 207, 209 and 211 as was the case for the tray 25. Thus, the feeds for each of the four process sections is controlled in a similar manner.

The manner of attachment of the paper stops 207, 209 and 211 to the paper stop brackets 215 may be in any of a number of ways, but attachment by screws extending into the brackets 215 and through the paper stops 207, 209 and 211 is one desirable method. As is shown in FIG. 6, screws 217 may be used. In addition, screws 219 may be used to attach the brackets 215 to the support plates 17 and 49.

Figure 7:
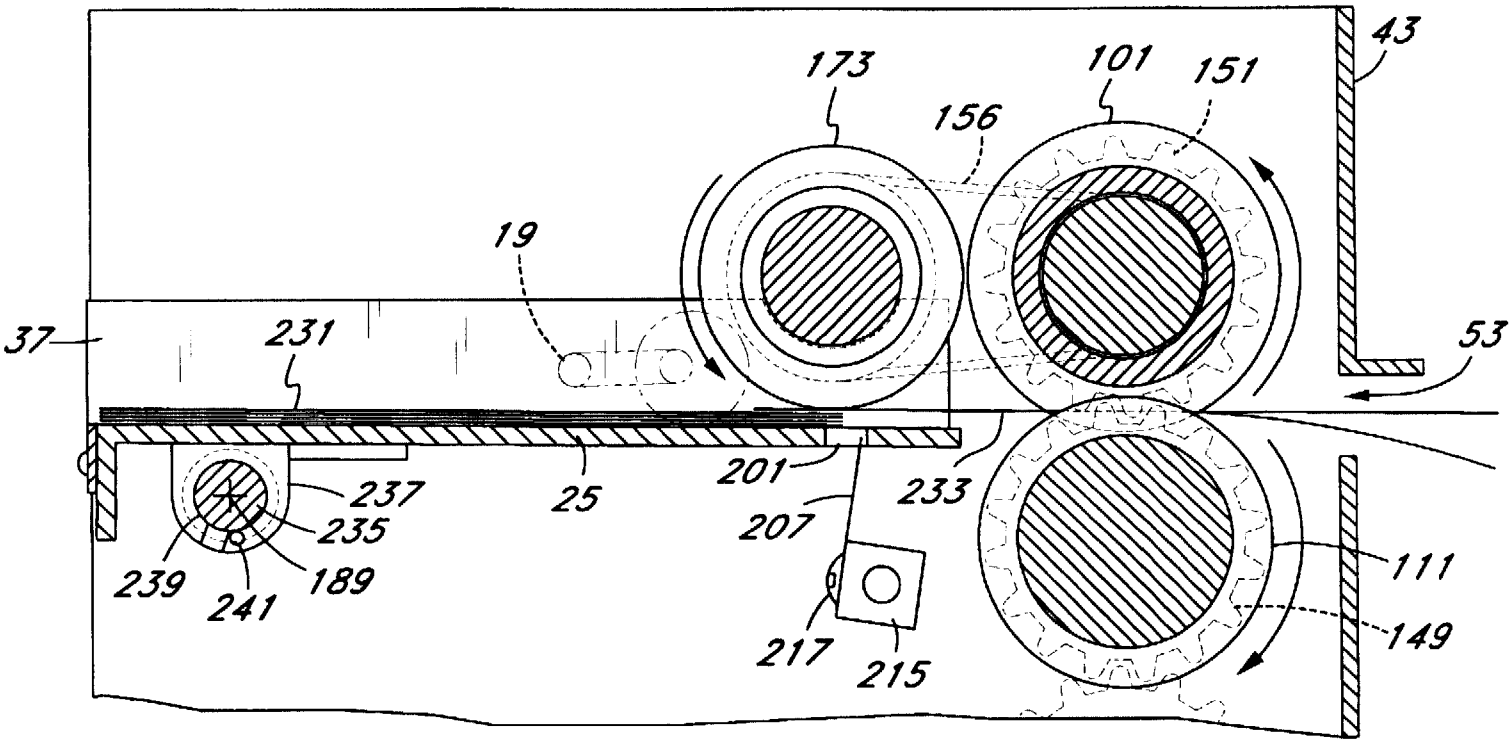
FIG. 7 is a side sectional view illustrating the operation of one paper tray and the cutter blades and exit slot and illustrating the processing of a stack of paper.

Referring to FIG. 7, a side sectional view illustrates in more detail the workings of the cutter 11, as well as the manner in which each of the paper trays 25, 27, 29, & 31 are spring biased. The tray 25 has a stack of paper 231, one sheet 233 of which is being cut as it is passed between blades 101 and 111. Note that the right edges of the stack of paper 231 are stopped by the paper stop 207, yet the one sheet 233 has had the clearance to pass over the paper stop 207 and on through the blades 101 and 111. The pivot point 189 is seen as being at the center of a paper tray pivot shaft 235. A flange 237 is connected to the bottom of the tray 25 and has an aperture 239 through which the paper tray pivot shaft 235 extends. The paper tray 25 and flange 237 is pivotable about the paper tray pivot shaft 235. A spring 241 surrounds the paper tray pivot shaft and urges the flange 237 circumferentially about the paper tray pivot shaft 235 to cause the tray 25 to be pivotally biased in the counterclockwise direction with respect to FIG. 7. This biasing causes the end of tray 25 adjacent the slot 201 to be urged upwardly toward the rubber roller 173. The magnitude of bias should be sufficient to offset the pivoting moment produced by the weight of the tray 25 and the weight of the stack of paper 231.

In this manner, when the tray 25 is full, and the paper tray 25 is tilted down, the paper stops 207, 209 and 211 are maximally extended upwardly from the surface of the paper tray 25 and provide a tall stop for the stack of paper 231. As the paper is fed through the cutters 97, 99, and 101, the stack of paper 231 starts to dissipate enabling the tray 25 to be angularly pivotally displaced in the counterclockwise direction to keep the top of the stack of paper urged against the rubber roller 173. In this manner, the stack of paper 231 is fed through a single sheet at a time with minimal overlap. As each sheet 253 is cut, it exits through the slot 51, and possibly into the catch tray 65 shown in FIG. 2. The energy to operate the cutter 11 is significantly less than would be the case for a full hydraulic cutting press. This is accomplished by cutting the sheets singly, rather than as a pressurized stack. However, the mechanical nature of the cutter 11 produces high quality, uniform cut sheets.

While the present invention has been described in terms of a cutter, as well as processes for making, using and constructing the cutter, one skilled in the art will realize that the structure and techniques of the present invention can be applied to many appliances. The present invention may be applied in any situation where uniform product is to be sequentially processed with minimum set-up time.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A cutting machine comprising:

a main structural support;

a first cutter means, supported by said main structural support, having a plurality of cutter blades for automatically serially cutting a first series of sheet material supplied from a stack, and providing a first type of cut;

a second cutter means, supported by said main structural support and underlying said first cutter means, having at least one set of cutter blades for automatically serially cutting a second series of sheet material supplied from a stack, and providing a second type of cut different than said first type of cut;

a third cutter means, supported by said main structural support and underlying said second cutter means, having a plurality of cutter blades for automatically serially cutting a third series of sheet material supplied from a stack, and for providing a third type of cut different than said first and said second types of cut;

power means, supported by said main structural support for simultaneously powering said first, second and third cutter means for use simultaneously.

2. The cutting machine as recited in claim 1 and further comprising scoring means, supported by said main structural support and interposed between said first and said second cutter means for scoring said sheet of material.

3. The cutting machine as recited in claim 2 and wherein said main structural support further comprises:

a first support plate; and a second support plate parallel to, spaced apart from and commonly supported with respect to said first support plate.

4. The cutting machine as recited in claim 3 wherein said scoring means further comprises:

a first scoring shaft rotatably supported between said first and said second support plates;

a male scoring roller supported by said first scoring shaft and having a circumferentially outwardly disposed rib;

a second scoring shaft rotatably supported between said first and said second support plates;

a female scoring roller supported by said second scoring shaft and having a circumferentially outwardly slot, and wherein said male scoring roller and said female scoring roller rotate against each other with the rib rotating within the slot.

5. The cutting machine as recited in claim 4 wherein said cutter further comprises:

a tray hold down structure pivotally supported by one of said first and said second support plates and having a lever portion on a first side of said one of said first and said second support plates and a shaft portion extending through said one of said first and said second support plates and terminating in a cam disk portion on a second side of said one of said first and said second support plates for engaging said tray and for holding said tray in a downward direction.

6. The cutting machine as recited in claim 3 wherein said first cutter means further comprises:

an upper blade shaft rotatably supported by said first and second support plates, and carrying a plurality of spaced apart upper circular cutter blades;

a lower blade shaft rotatably supported by said first and second support plates, and carrying a plurality of spaced apart lower circular cutter blades, each of said plurality of spaced apart lower circular cutter blades urged into cutting contact with an associated one of said plurality of spaced apart upper circular cutter blades, and wherein said upper blade shaft is mechanically rotatably connected to said lower blade shaft.

7. The cutting machine as recited in claim 1 and further comprising:

a housing cover having a series of slots, each slot associated with one of said cutter means; and a card diffuser and support, supported by said housing cover for receiving cards cut by one of said cutter means.

8. The cutting machine as recited in claim 7 wherein said housing cover has at least two projections extending therefrom, and further comprising a removable tray having a planar portion terminating at an upwardly directed lip portion and a front bracket adjacent said planar portion having at least two keyhole apertures for engaging said projections on said housing cover.

9. A cutting machine comprising:

a main structural support, and including a first support plate; and a second support plate parallel to, spaced apart from and commonly supported with respect to said first support plate;

a first cutter means, supported by said main structural support, having a plurality of cutter blades for cutting a first series of sheet material;

wherein said first cutter means further comprises:

an angularly pivotable and biased tray pivotably supported by said first and said second support plates;

a feed roller shaft rotatably supported by said first and said second support plates and mechanically powered by one of said upper and said lower blade shafts; and a feed roller supported by said roller shaft and overlying said tray; and wherein said tray is pivotally biased in the direction of said feed roller;

a second cutter means, supported by said main structural support and underlying said first cutter means, having at least one set of cutter blades for cutting a second series of sheet material;

a third cutter means, supported by said main structural support and underlying said second cutter means, having a plurality of cutter blades for cutting a third series of sheet material;

power means, supported by said main structural support for simultaneously powering said first, second and third cutter means;

scoring means, supported by said main structural support and interposed between said first and said second cutter means for scoring at least one of said first, second and third series of sheet material, and wherein said scoring means further comprises:

a first scoring shaft rotatably supported between said first and said second support plates;

a male scoring roller supported by said first scoring shaft and having a circumferentially outwardly disposed rib;

a second scoring shaft rotatable supported between said first and said second support plates;

a female scoring roller supported by said second scoring shaft and having a circumferentially outwardly slot, and wherein said male scoring roller and said female scoring roller rotate against each other with the rib rotating within the slot.

10. A cutting machine comprising:

a pair of support plates including a first support plate and a second support plate parallel to, spaced apart from and supported with respect to said first support plate;

a plurality of cutter means, each cutter means supported between said pair of support plates, each having a pair of cutter blades workable in concert for automatically serially cutting a series of sheet material supplied from a stack, and each one of said plurality of cutter means for providing a different type of cut;

power means, supported by one of said first and said second support plates for powering each of said plurality of cutter means simultaneously, said plurality of cutter means usable simultaneously.

11. The cutting machine as recited in claim 10 wherein each of said plurality of cutter means further comprises:

an upper blade shaft rotatably supported by said pair of support plates, and carrying at least one circular cutter blade;

a lower blade shaft rotatably supported by said pair of support plates, and carrying at least one circular cutter blade cooperable with the circular cutter blade carried by said upper blade shaft; and wherein said upper blade shaft is mechanically rotatably connected to said lower blade shaft.

12. The cutting machine as recited in claim 11 and further comprising:

a motor carrying a shaft rotationally supported by first support plate;

a drive gear attached to said shaft;

a lower driven gear attached to said lower blade shaft;

an upper driven gear, engaged by said lower driven gear, and attached to said upper blade shaft; and wherein said lower driven gear of one of said plurality of said cutter means engages said drive gear, and wherein said lower driven gear of the other of said plurality of said cutter means engages said upper driven gear of another of said plurality of said cutter means.

13. The cutting machine as recited in claim 10 wherein said plurality of cutter means further comprises:

a first cutter means for cuttably dividing sheets of material;

a second cutter means for cuttably dividing sheets of material into two lengths having predetermined widths; and a third cutter means for cuttably dividing sheets of material into five lengths having predetermined widths.

14. The cutting machine as recited in claim 10 and further comprising:

a housing cover having a series of slots, each slot associated with one of said cutter means; and a card diffuser and support, supported by said housing cover for receiving cards cut by one of said cutter means.

15. A cutting machine comprising:

a pair of support plates including a first support plate and a second support plate parallel to, spaced apart from and supported with respect to said first support plate;

a plurality of cutter means, each cutter means supported between said pair of support plates, each having a pair of cutter blades workable in concert for cutting a series of sheet material, and wherein each of said plurality of cutter means further comprises:

an upper blade shaft rotatable supported by said pair of support plates, and carrying at least one circular cutter blade;

a lower blade shaft rotatable supported by said pair of support plates, and carrying at least one circular cutter blade cooperable with the circular cutter blade carried by said upper blade shaft; and wherein said upper blade shaft is mechanically rotatable connected to said lower blade shaft; and wherein each of said plurality of cutter means further comprises:

an angularly pivotable and biased tray pivotably supported by said pair of support plates;

a feed roller shaft rotatably supported by said pair of support plates; and a feed roller supported by said feed roller shaft and overlying said tray; and wherein said tray is pivotally biased in the direction of said roller; and power means, supported by one of said first and said second support plates for powering each of said plurality of cutter means simultaneously and including a motor carrying a shaft rotationally supported by first support plate;

a drive gear attached to said shaft;

a lower driven gear attached to said lower blade shaft;

an upper driven gear, engaged by said lower driven gear, and attached to said upper blade shaft; and wherein said lower driven gear of one of said plurality of said cutter means engages said drive gear, and wherein said lower driven gear of the other of said plurality of said cutter means engages said upper driven gear of another of said plurality of said cutter means.

16. The cutting machine as recited in claim 15 and wherein each tray has at least one paper stop slot through which other structures may be engaged and wherein each of said plurality of cutter means further comprises:

a paper stop bracket supported between said pair of support plates;

a paper stop supported by said paper stop bracket and extendable through said paper stop slot of said tray when said tray is in a lower position, as said paper stop slot is brought down around said paper stop, said paper stop to provide a barrier to a stack of said sheet of material.

17. The cutting machine as recited in claim 16 wherein each of said plurality of said cutter means further comprises:

a tray hold down structure pivotally supported by one of said first and said second support plates and having a lever portion on one side of said one of said first and said second support plates and a shaft portion extending through said one of said first and said second support plates and terminating in a cam disk portion on the other side of said one of said first and said second support plates for engaging said tray and for holding said tray in a downward direction.

* * * * *